US011220314B2

(12) United States Patent
Sven Atle et al.

(10) Patent No.: US 11,220,314 B2
(45) Date of Patent: Jan. 11, 2022

(54) SYSTEM AND METHOD FOR CONNECTING A MOORING LINE TO A BODY

(71) Applicant: APL NORWAY AS, Kolbjørnsvik (NO)

(72) Inventors: Svensen Sven Atle, Eydehavn (NO); Hovde Geir Olav, His (NO)

(73) Assignee: APL NORWAY AS, Kolbjørnsvik (NO)

( * ) Notice: Subject to any disclaimer, the term of this patent is extended or adjusted under 35 U.S.C. 154(b) by 0 days.

(21) Appl. No.: 16/756,414

(22) PCT Filed: Oct. 16, 2018

(86) PCT No.: PCT/NO2018/000020
§ 371 (c)(1),
(2) Date: Apr. 15, 2020

(87) PCT Pub. No.: WO2019/078725
PCT Pub. Date: Apr. 25, 2019

(65) Prior Publication Data

US 2021/0188402 A1 Jun. 24, 2021

(51) Int. Cl.
*B63B 21/50* (2006.01)
*B63B 21/10* (2006.01)
(Continued)

(52) U.S. Cl.
CPC ..... *B63B 21/507* (2013.01); *B63B 21/10* (2013.01); *B63B 21/18* (2013.01); *B63B 2021/203* (2013.01); *B63B 2021/505* (2013.01)

(58) Field of Classification Search
CPC ..... B63B 21/507; B63B 21/10; B63B 21/18; B63B 2021/505; B63B 2021/203
See application file for complete search history.

(56) References Cited

U.S. PATENT DOCUMENTS 5,845,893 A * 12/1998 Groves ..... B63B 21/10 254/389
7,240,633 B2 * 7/2007 Barlow ..... B63B 21/04 114/200
(Continued)

FOREIGN PATENT DOCUMENTS

CN 105398545 A 3/2016
FR 3 018 063 A1 9/2015
(Continued)

OTHER PUBLICATIONS

Norwegian Search Report, dated May 3, 2018, for Norwegian Application No. 20171638, along with an English translation.
(Continued)

*Primary Examiner* — Anthony D Wiest
(74) *Attorney, Agent, or Firm* — Birch, Stewart, Kolasch & Birch, LLP

(57) ABSTRACT

The disclosed invention relates to a connecting system for connecting a mooring line to a body comprising a first part being attached to the mooring line and connected with a pin having two ends, to a second part being attached to the body and having an arrangement for guiding the pin into a hang-off structure in the second part where the hang-off structure substantially comprises at least one hook. The system is characterized by a connecting structure for a temporary pulling means mounted on the first part in transverse direction to its longitudinal axis and eccentrically to an axial center of gravity of the first part. The invention relates also to a method regarding the application of the system.

18 Claims, 17 Drawing Sheets

(51) Int. Cl.
*B63B 21/18* (2006.01)
*B63B 21/20* (2006.01)

(56) References Cited

U.S. PATENT DOCUMENTS

| | | | | |
|---|---|---|---|---|
| 7,926,436 | B2 * | 4/2011 | Boatman | B63B 21/18<br>114/230.2 |
| 2001/0029878 | A1 * | 10/2001 | Seaman | B63B 21/50<br>114/230.12 |
| 2010/0031863 | A1 | 2/2010 | De Baan et al. | |
| 2010/0175604 | A1 * | 7/2010 | Boatman | B63B 21/04<br>114/200 |
| 2012/0031320 | A1 * | 2/2012 | Bauduin | B63B 22/04<br>114/264 |
| 2012/0160146 | A1 * | 6/2012 | Miller | B63B 21/10<br>114/200 |
| 2020/0094923 | A1 * | 3/2020 | Smith | B63B 21/50 |

FOREIGN PATENT DOCUMENTS

| | | | |
|---|---|---|---|
| WO | WO 03/026953 | A1 | 4/2003 |
| WO | WO 2010/137990 | A1 | 12/2010 |
| WO | WO 2016/051428 | A2 | 4/2016 |

OTHER PUBLICATIONS

International Search Report for PCT/NO2018/000020 (PCT/ISA/210) dated Jan. 29, 2019.
Written Opinion of the International Searching Authority for PCT/NO2018/000020 (PCT/ISA/237) dated Jan. 29, 2019.

* cited by examiner

SYSTEM AND METHOD FOR CONNECTING A MOORING LINE TO A BODY

TECHNICAL FIELD

The present invention relates to offshore mooring systems. More specifically it relates to a diver-less connection system between a mooring line and a ground-fixed structure or between a mooring line and a floating vessel.

BACKGROUND

Mooring lines are typically connected to a structure on the seabed (anchor) at one end and to a floating body at the other end. Especially towards the floating body, typically a vessel, the connection preferably needs to provide a dual axis hinge (typically two axis rotated 90 degrees relative each other) to avoid excessive loading and wear of the mooring components from the relative motion between the floating vessel and the mooring line. Some mooring line designs may also require a dual axis connection towards the seabed due to similar relative motions, such as mooring lines for deep water applications, where the complete mooring line is lifted of the seabed in all conditions. It is also beneficial that this dual axis connection can be installed without employing a diver and be able to provide an easy way to disconnect and reconnect a mooring line during the life time, e.g. in case a mooring line needs to be repaired or replaced due to damages. The connection should also be general in its design, such that it can interface with any type of mooring components, such as chain, steel wire ropes and synthetic fiber ropes.

Related prior art is disclosed in U.S. Pat. No. 5,845,893, US20010029878A1, U.S. Pat. No. 7,240,633B2, US201000175604A1, U.S. Pat. No. 7,926,436B2, US20120031320A1, US20120160146A1, WO2013186553A1, WO2014339485A1, WO20160687717A1 and WO2016118006A1.

SUMMARY

The disclosed invention relates to a connecting system for connecting a mooring line to a body comprising a first part being attached to the mooring line and connected with a pin having two ends, to a second part being attached to the body and having an arrangement for guiding the pin into a hang-off structure in the second part where the hang-off structure substantially comprises at least one hook. The system is characterized by a connecting structure for a temporary pulling means mounted on the first part in transverse direction to its longitudinal axis and eccentrically to an axial center of gravity of the first part.

In a preferred embodiment of the connecting system the second part comprises a stopper arrangement for limiting a pull-in distance for the pin and thus the first part.

In a further preferred embodiment of the connecting system, the stopper arrangement is arranged to guide the pin into the hang-off structure.

In a further preferred embodiment of the connecting system, the guiding arrangement in the second part for the pin—the pin being rotatably fixed to the first part—allows the pin to be guided along at least two sides of the hang-off structure.

In a further preferred embodiment of the connecting system, a guide head partly enclosing the first part facilitates fine adjustment of directional and rotational position of the first part relative to the second part for guiding the first part in-between a lug structure of the second part.

In a further preferred embodiment of the connecting system, the temporary pulling means is an auxiliary line temporarily connecting the first part to an external pulling device.

In a further preferred embodiment of the connecting system, the connecting structure for temporary pulling means and guide head for fine adjustment of directional and rotational position of the first part relative to the second part are a combined structure attached to the first part.

In a further preferred embodiment of the connecting system, the guiding structure in the second part is arranged to guide the pin into a final position and where the pin in its final position is locked by means operated by one of the group consisting of gravity, spring force, manual operation and use of a remotely operated vehicle.

In a further preferred embodiment of the connecting system, at least one secondary connection link is inserted between the main connecting link and the mooring line to reduce in-plane and out-of-plane loads in the mooring line due to friction in the means for rotational movements between first and second part of the system and between second part of the system and the mooring line.

In a further preferred embodiment of the connecting system, the hang-off structure is a pair of hooks, each hook being arranged to engage one end of the pin.

Another aspect of the present invention is a method for connecting a mooring line to a body using a connecting system as described above. The method comprises the following steps:

a) attaching a first part of the connecting system to a mooring line;
b) attaching a second part of the connecting system to the body;
c) pulling a main connecting link including a pin, both being part of the first part, with a pulling line attached to means on the first part through a guide structure on the second part into a hang-off structure on the second part;
d) hanging off the first part by the pin to the hang-off structure of the second part by relieving a pulling tension in the pulling line.

In a preferred embodiment of the method, the pulling line is attached to the system before step c) and removed after performing step d).

In a preferred embodiment of the method, at least one secondary connection link is inserted between the mooring line and the main connecting link during step a).

In a preferred embodiment of the method, the pulling is performed by one of a group consisting of a supplementary vessel and a pulling device on board the body.

In a preferred embodiment of the method, the pulling line runs through a sheave arrangement, the sheave being attached to the body if the mooring line is to be connected to the body,
a mooring anchor if the mooring line is to be connected to the anchor.

BRIEF DESCRIPTION OF THE FIGURES

Below, various embodiments of the invention will be described with reference to the figures, in which FIG. 1 gives a typical general arrangement of a moored unit with its mooring lines.

DETAILED DESCRIPTION OF PREFERRED EMBODIMENTS

The objective of this inventive concept is to manage a diver-less connection of a mooring line to a ground-fixed or floating body when the mooring line is under tension at the time of connection. Same inventive concept shall also manage a diver-less disconnection of the mooring line from the same body.

Figure 1:
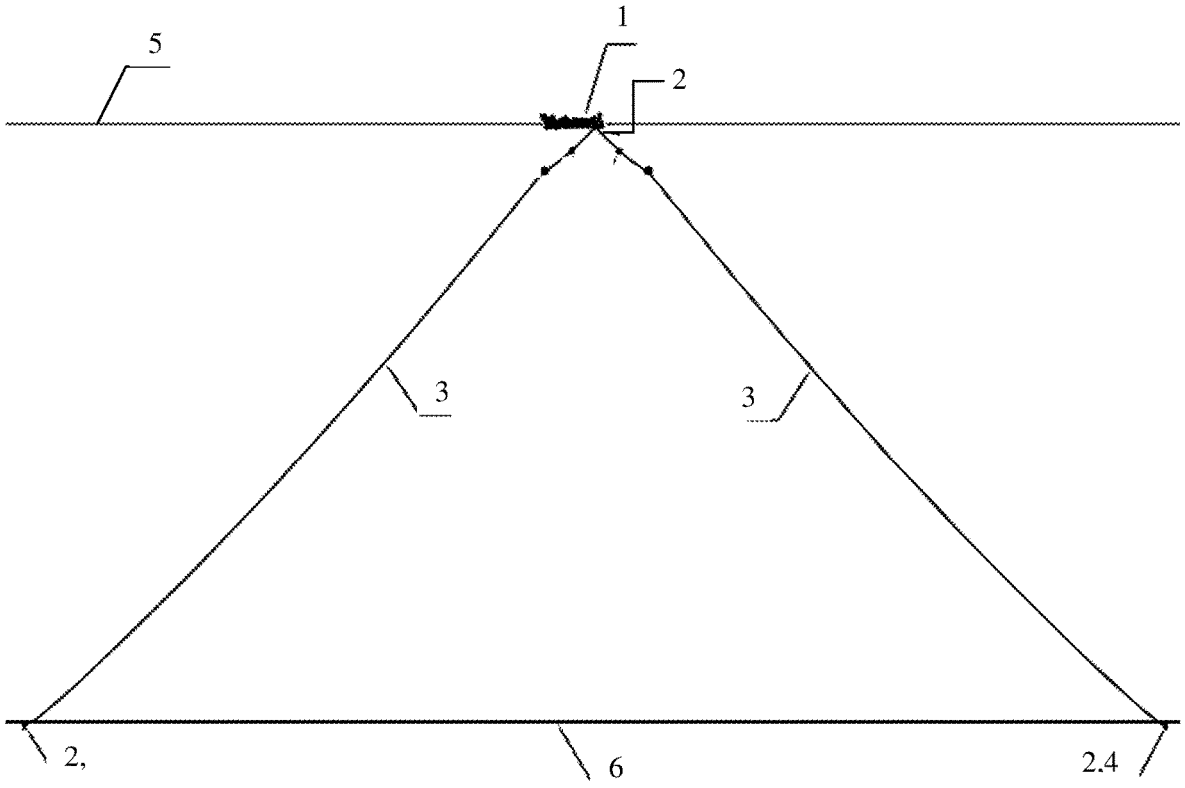

FIG. 1 gives an overall view of the arrangement using the mooring connection system according to the intervention. The operation can be performed with the help of an auxiliary vessel on the sea surface 5 in combination with an ROV (Remotely Operated Vehicle). The connection is conducted by a means of pulling on the surface vessel, such as a winch and/or bollard pull, in combination with an ROV that can observe the operation and conduct minor operations such as connecting and disconnecting a pull line and attach a temporary sheave arrangement on the moored vessel (floating body) 1 if a permanently sheave arrangement does not exist. The sheave arrangement guides the pull line from the mooring connection system 2 at the end of the mooring line 3 via the moored vessel 1 to the auxiliary surface vessel. Alternatively, the sheave is fixed or temporarily located on the moored unit 1 such that the pull rope is routed to a winch or similar on the moored unit 1 instead of to the auxiliary surface vessel. The mooring connection system may also be located on a ground-fixed structure (body), such as a mooring anchor 4 on the sea floor 6. The sheave will then be attached to the mooring anchor 4.

Figure 2:
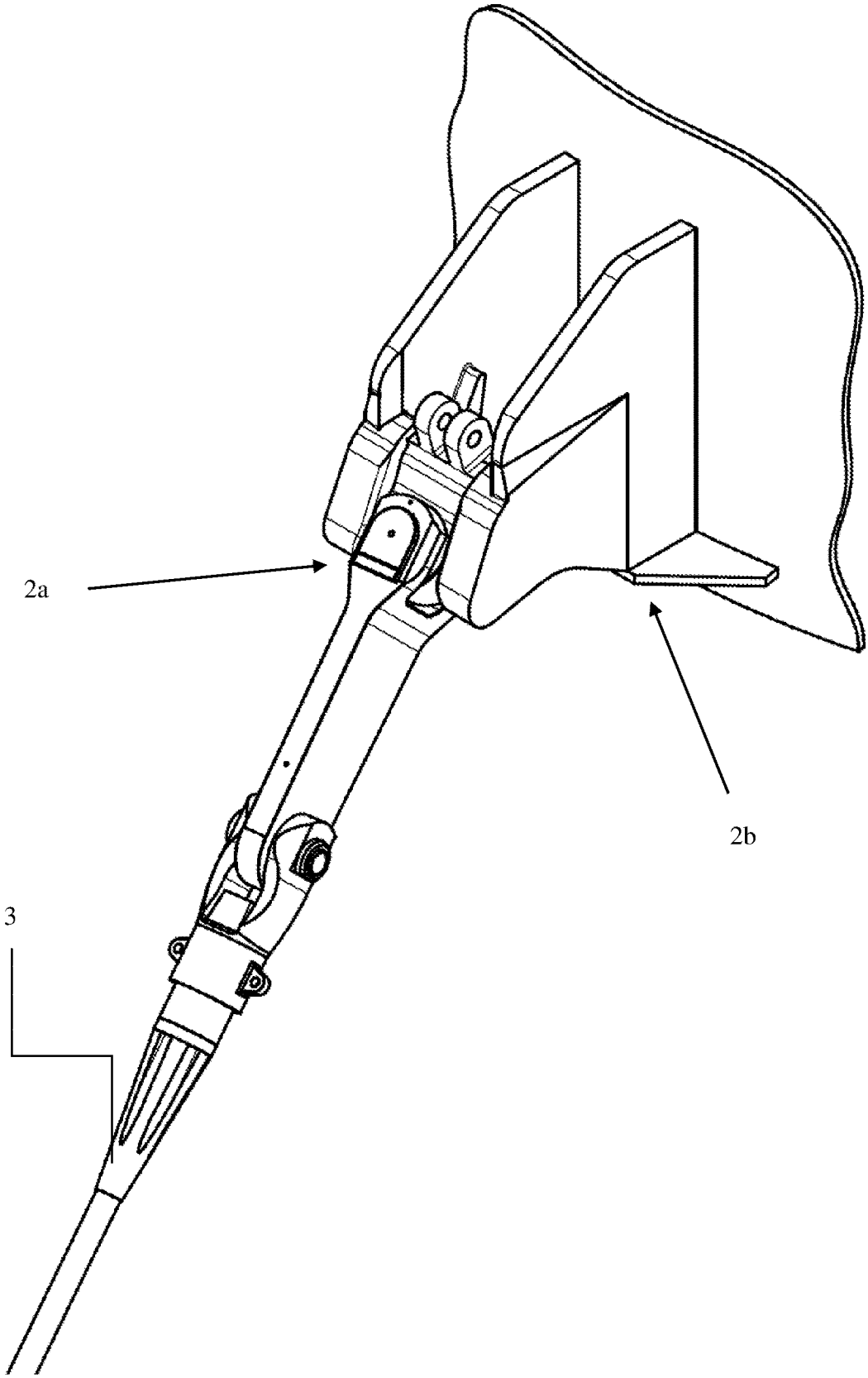
FIG. 2 shows the general arrangement of the connection system when connected
Figure 3:
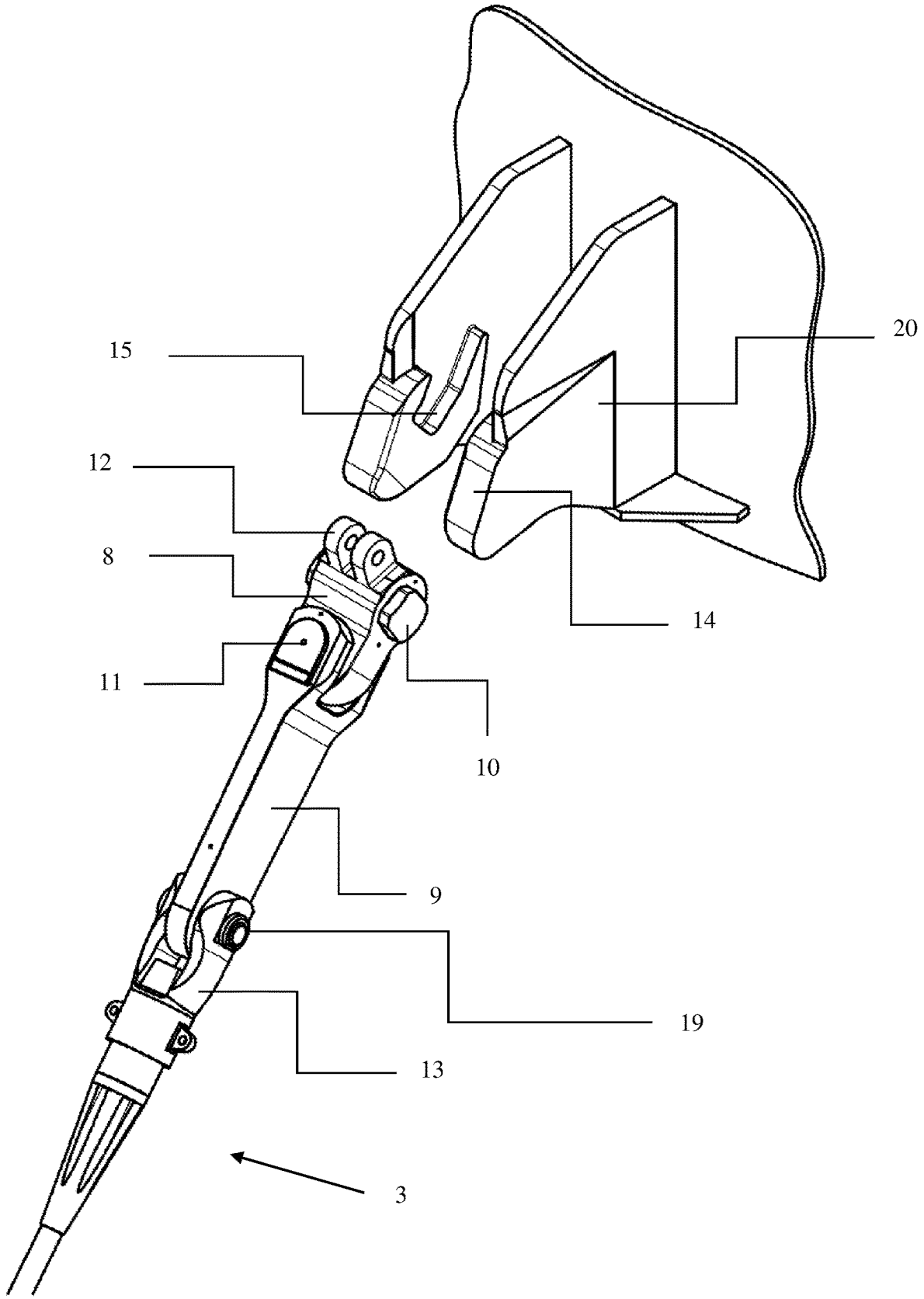
FIG. 3 shows the general arrangement of the connection system before connection

FIG. 2 and FIG. 3 show the mooring connection system 2 in fully connected mode and in disconnected mode, respectively. The system comprises two parts, whereof the first part 2*a* is attached to the mooring line 3 and the second part 2*b* is permanently attached to a floating body (such as a moored vessel 1) or an ground-fixed body (such as a mooring anchor 4).

Figure 5:
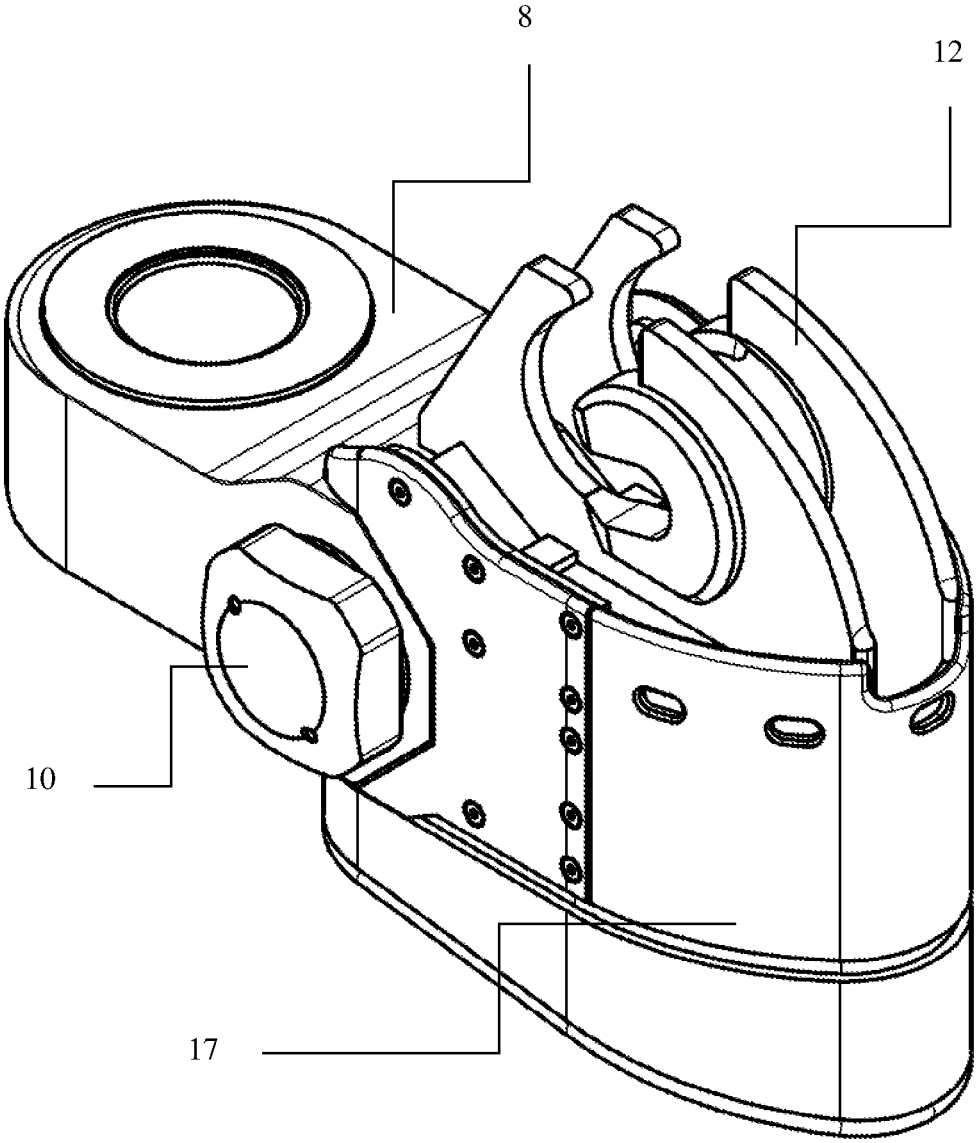
FIG. 5 shows the part of the system fixed to the mooring line with pull head
Figure 6:
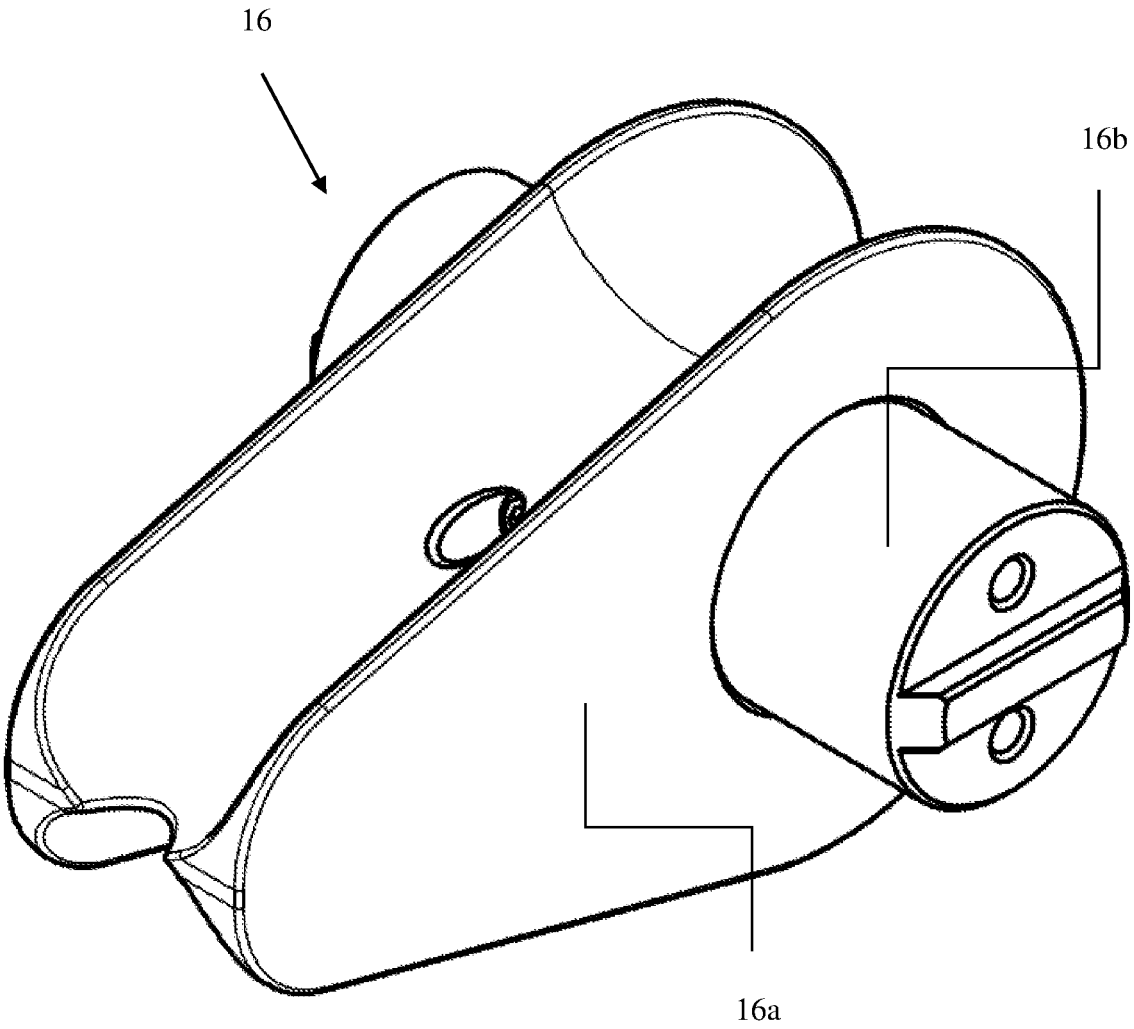
FIG. 6 shows thimble with integrated pin for pull line

First system part 2*a* further comprises a main connecting link 8 where a pin 10 between the body of the main connecting link and the pin is attached to a first end of the main connecting link 8 that connects to second system part 2*b*. The pin 10 can rotate inside the body of the connecting link 8, and will typically be fitted with bearings 24 for low friction rotations. First part 2*a* further comprises means 12 for attaching a pull line 18. The means 12 can be closed pad eyes as shown in FIG. 2 and FIG. 3, or an open structure as shown in FIG. 5 typically for diver-less connection/disconnection of a thimble 16, see FIG. 6, of the pull line 18. Second end of the main connecting link 8 has means 11 for connecting directly to a mooring line 3 or to the first end of an optional secondary connecting link 9. Means 11 will typically be a pin with same rotational functions as pin 10. A secondary connecting link 9 may be required if out-of-plane and/or in-plane-bending loads are critical for mooring line 3. The optional secondary connecting link 9 provides a further hinge and will then have means 19 for connecting second end of said link 9 to the mooring line 3. The section of the mooring line 3 attached to link 8 or link 9 is chain, steel wire, synthetic fiber rope, or any other suitable means and end 13 is typically a shackle for chain, a socket for steel wire rope and a thimble for synthetic fiber rope or corresponding means for other types of mooring lines.

Part 2*b* comprises a substantially symmetrical lug structure 20 with external guides 14 for guiding the pin 10 of part 2*a* of the system into a hang-off structure, substantially a hook pair 15 of second part 2*b*. Pin 10 rotates inside link 8 of part 2*a* as described above, but at each end the pin is shaped such that it—once settled in the hang-off hook pair—cannot rotate relative to the hang-off hook pair; all rotational motions around the pin axis when fully connected is thus taken as rotation of pin 10 inside link 8.

A successful connection between first and second parts 2*a*, 2*b* requires that first part 2*a* is correctly rotated about its longitudinal axis direction 21 before touching second part 2*b*, i.e. pin 10 needs guiding by both external guides 14 (a guide for each end of the pin) to be properly guided into the hang-off hook pair 15. To obtain the correct orientation, means 12 for attaching the pull line 18 is located on the upper side of link 8, i.e. located above the center of gravity (relative the longitudinal axis direction 21) of the assembly comprising items 13, 19, 9, 11, 8, 10 and 12. This eccentricity together with earth gravity and mass of the assembly will thus secure correct orientation of first part 2*a* before touching second part 2*b*.

Figure 4:
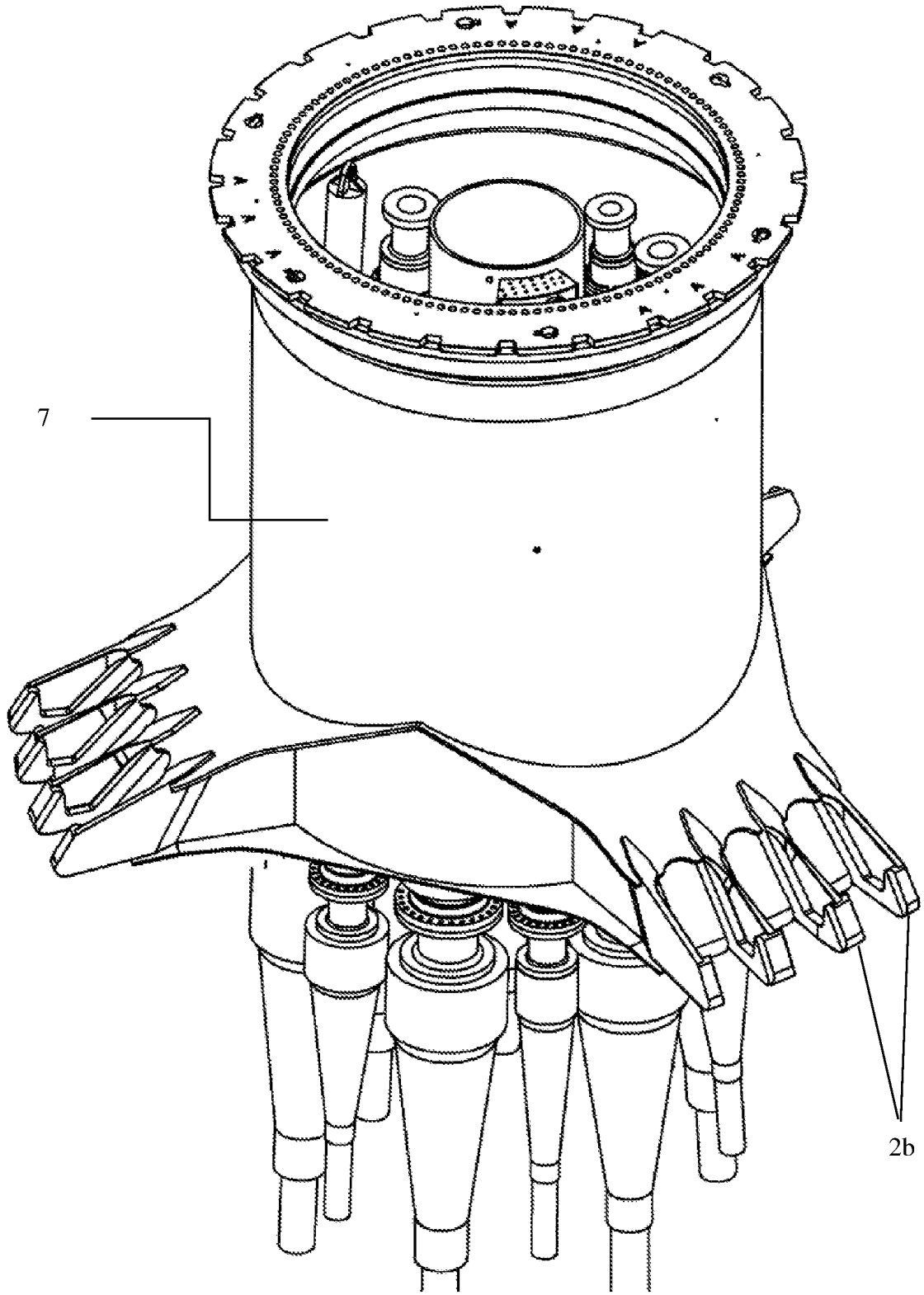
FIG. 4 shows the general arrangement of a turret arrangement for a moored unit prepared for several mooring connection systems

FIG. 4 shows a plurality of second parts 2*b* (3 groups of 3, one group not really visible in FIG. 4) integrated in a turret 7 for connecting a plurality of mooring lines with first parts 2*a*. For connection system 2 between mooring line 3 and moored vessel 1, the fixed part 2*b* will be permanently attached to the hull of the moored vessel 1 for a spread moored vessel, and permanently attached to the turret 7 for a turret moored vessel, in which the turret allows the vessel to weather-vane.

Figure 9:
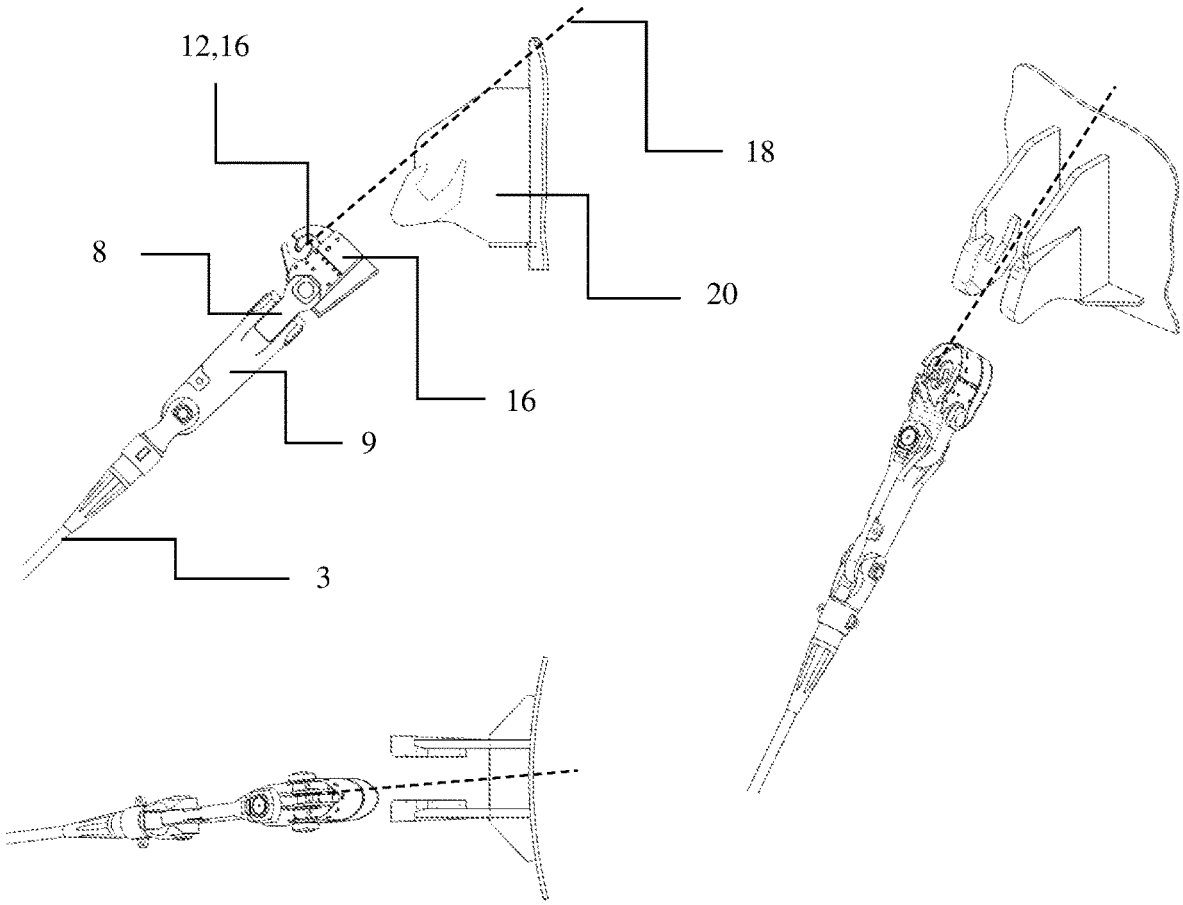
FIG. 9 shows situation before connection of the system with pull-head
Figure 10:
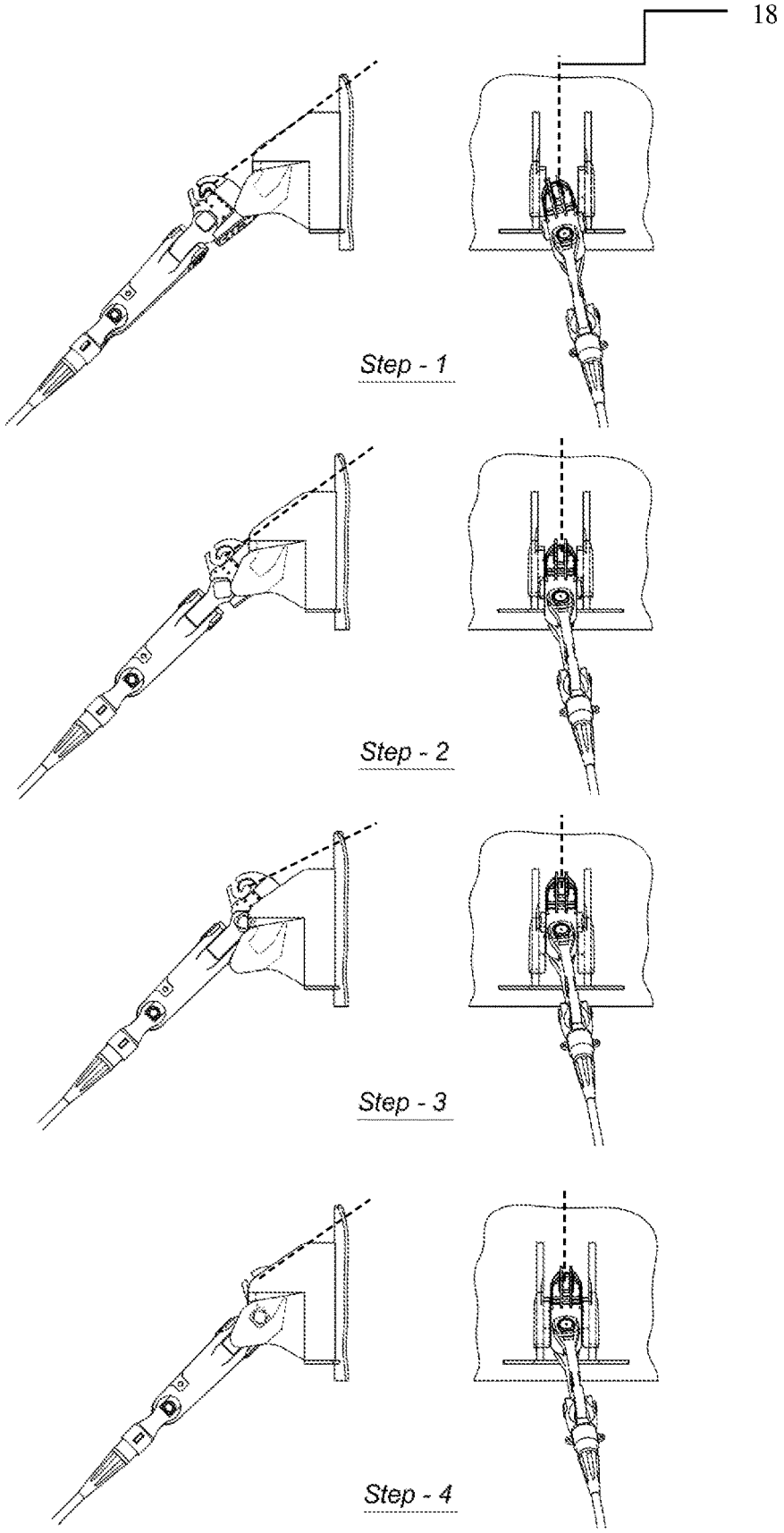
FIG. 10 shows side and inline view of pull-in sequence and alignment with pull-head
Figure 16:
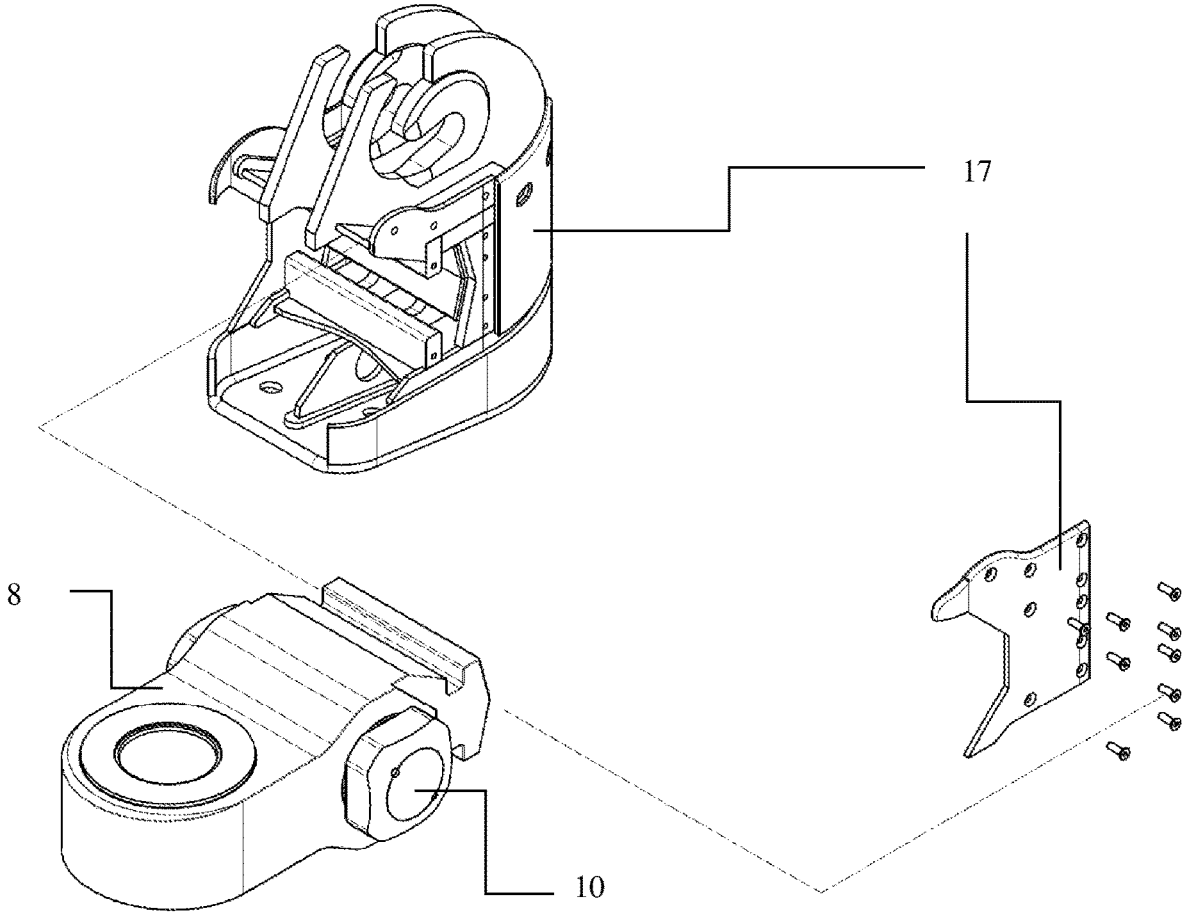
FIG. 16 shows assembly of main connecting link and pull head
Figure 17:
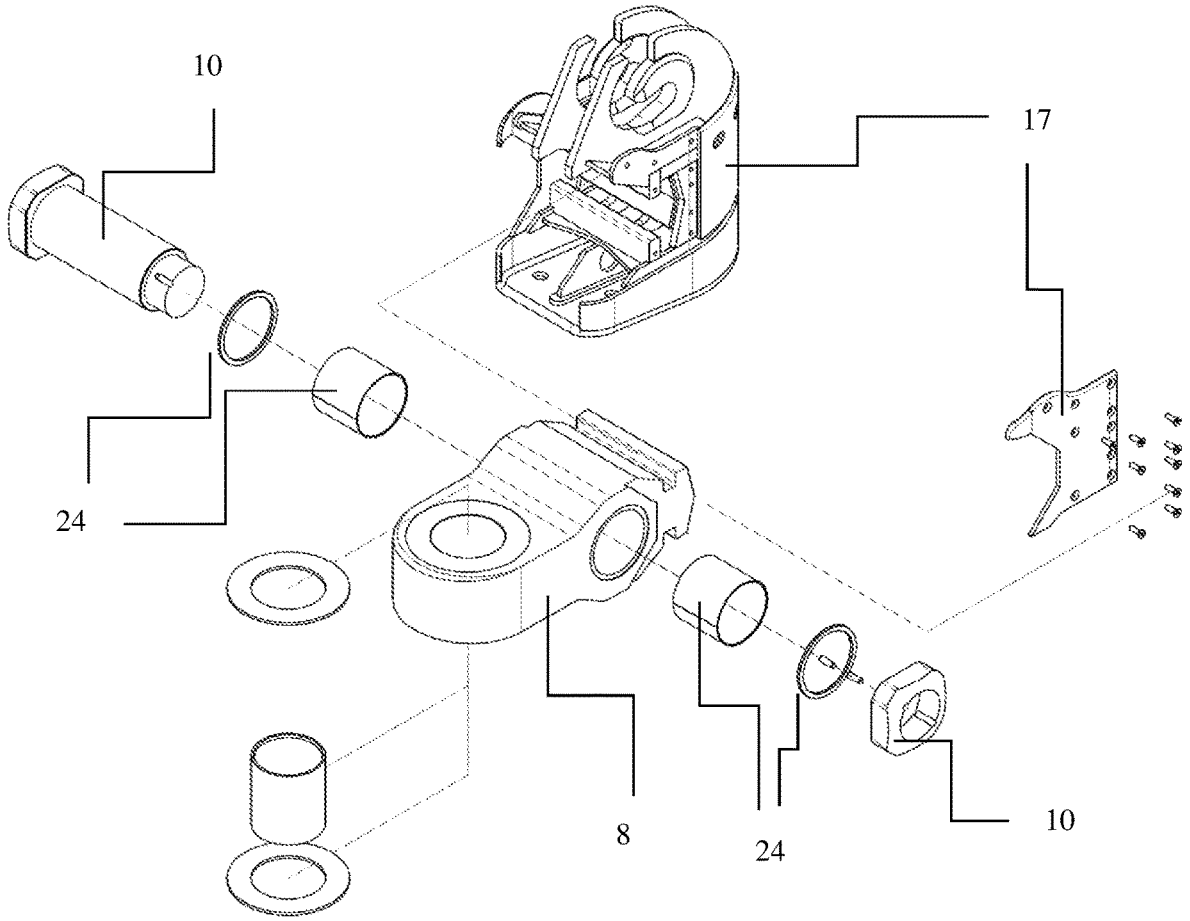
FIG. 17 shows assembly of main connecting link and pull head including pin

FIG. 5, FIG. 16 and FIG. 17 show optional secondary means 17 for fine adjustment of the rotation of part 2*a* about its longitudinal axis direction 21. This guide head 17 is shaped with sides that will rotate link 8 with pin 10 to align with external guides 14 when guide head 17 is positioned between the two lugs 20 of part 2*b*. The sides of the guide head 17 are also curved towards each other such that the separation between the sides is smaller in front end compared to aft end (closest to pin 10) of the guide structure. This shape from wide to narrow increases the flexibility to handle sidewise/directional misalignment between first and second parts 2*a*, 2*b* during connection. Fine adjustment of rotation about the longitudinal axis and the sidewise/directional alignment control are illustrated in FIG. 9 and FIG. 10.

The means 12 for connecting a pull line 18 and the optional guide head 17 to guide first part 2*a* into second part 2*b* can, as an alternative to a fully integrated part of link 8, be a separate unit attached to the main connecting link 8 as shown in FIG. 5, FIG. 16 and FIG. 17.

Figure 7:
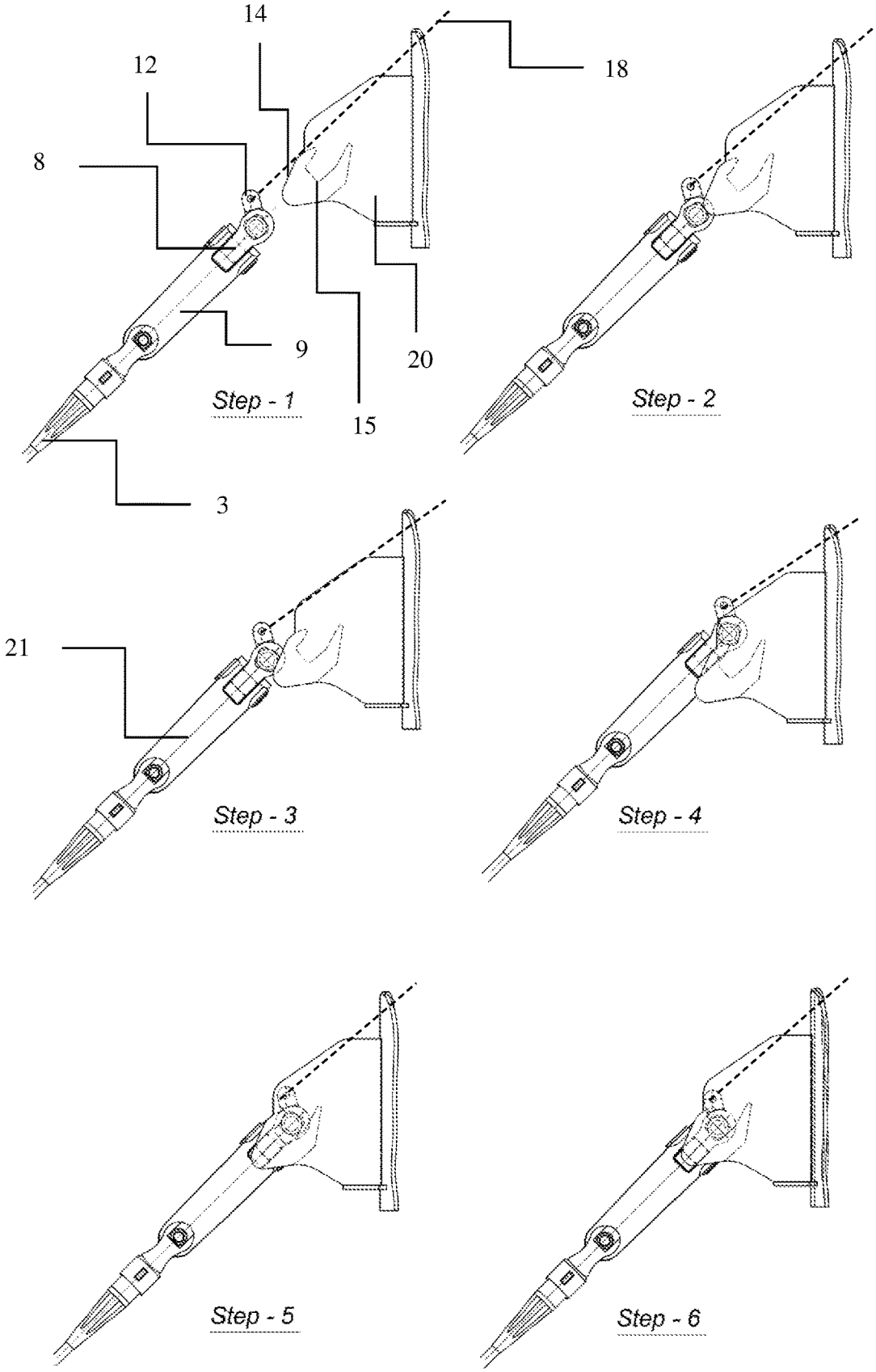
FIG. 7 shows side view of pull-in sequence with fixed sheave position
Figure 8:
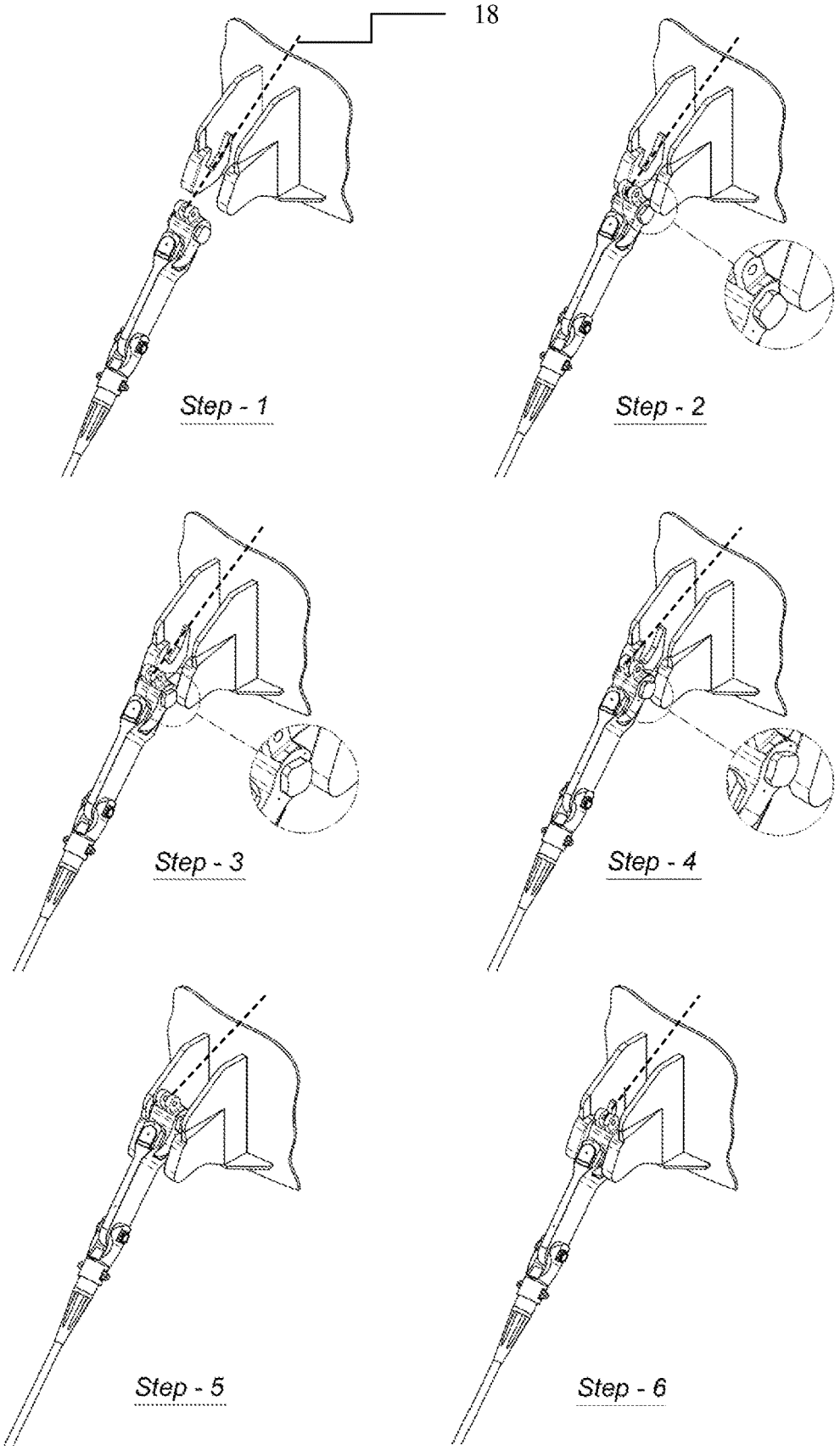
FIG. 8 shows pull-in sequence with different view angle

FIG. 7 and FIG. 8 show the last part of the connection sequence of mooring first part 2*a* and second part 2*b*. Step 1 gives a snapshot of the time instant just before first part 2*a* gets in contact with second part 2*b*. Step 2 shows the time instant when pin 10 gets in contact with the guide structure 14. Step 3 and Step 4 show the guiding of pin 10 along the guide structure 14, followed by Step 5 where pin 10 enters the hang-off 15. Step 6 shows pin 10 in the final position in hang-off 15.

These steps reflect the steps if the sheave arrangement for pull-in is at a fixed position during the pull-in sequence. The sheave position can alternatively be moved during the pull-in sequence. In this way first part 2*a* do not have to get in contact with the guide structure 14, but be lead around it and into the hang-off hook pair 15 by changing the position of the sheave at the same time as pulling on and paying out the pull line 18.

Figure 11:
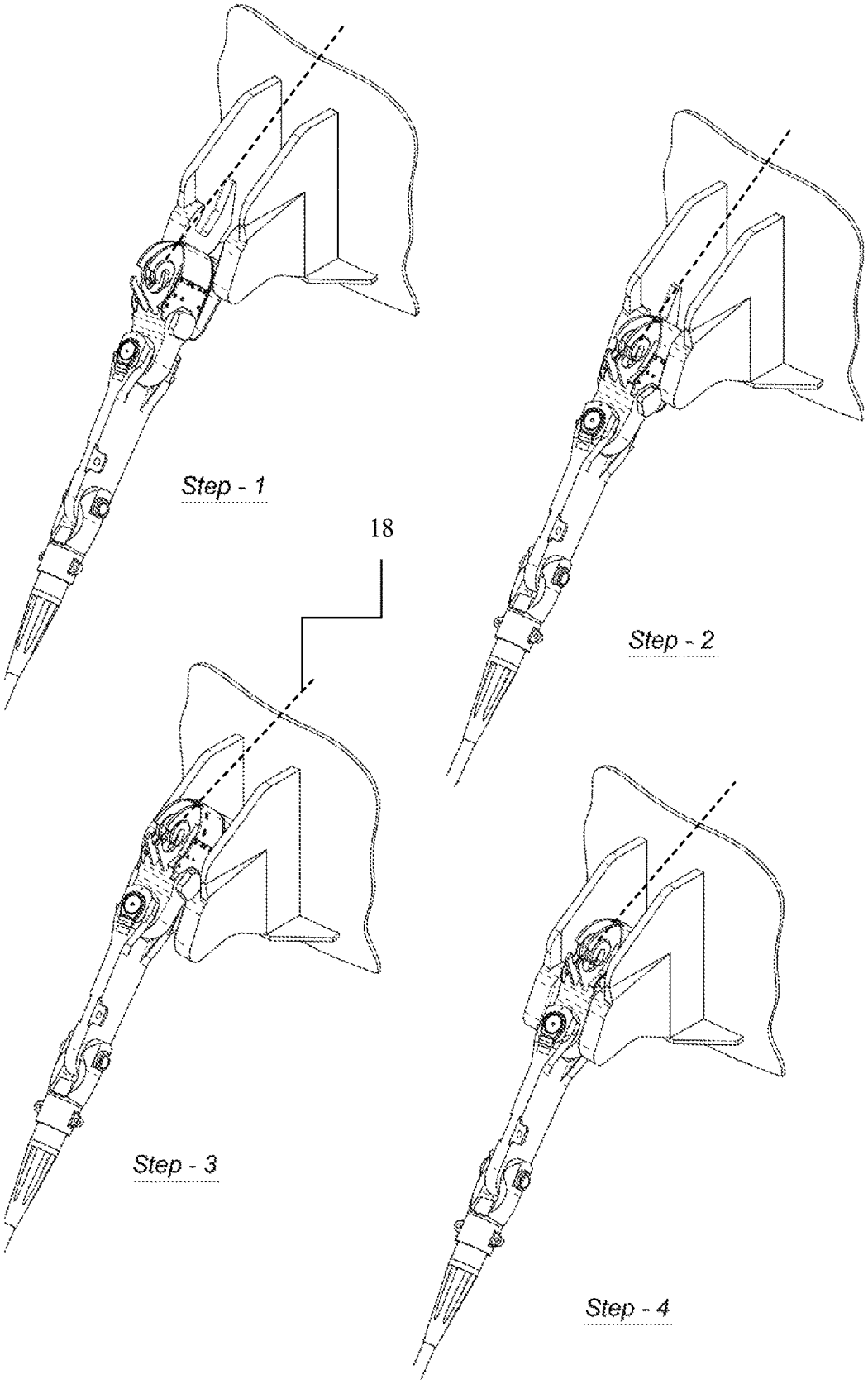
FIG. 11 shows pull-in sequence and alignment with pull-head

FIG. 10 and FIG. 11 show similar steps as FIG. 7 and FIG. 8, but reflect that first part 2*a* has a secondary guide head 17 for secondary rotational and directional adjustment after the main adjustment by the eccentric primary means 12 for alignment.

Disconnection can be done by following the same steps, but in opposite order, as for connection. Only difference is that the sheave position must be changed such that pin 10 of first part 2*a* gets out of the hang-off hook pair 15 and follows a path along guides 14 when pull line 18 is first tensioned to free pin 10 from hang-off hook pair 15 and then slackened such that pin 10 moves along guides 14 until first part 2*a* is fully free from second part 2*b*.

Figure 12:
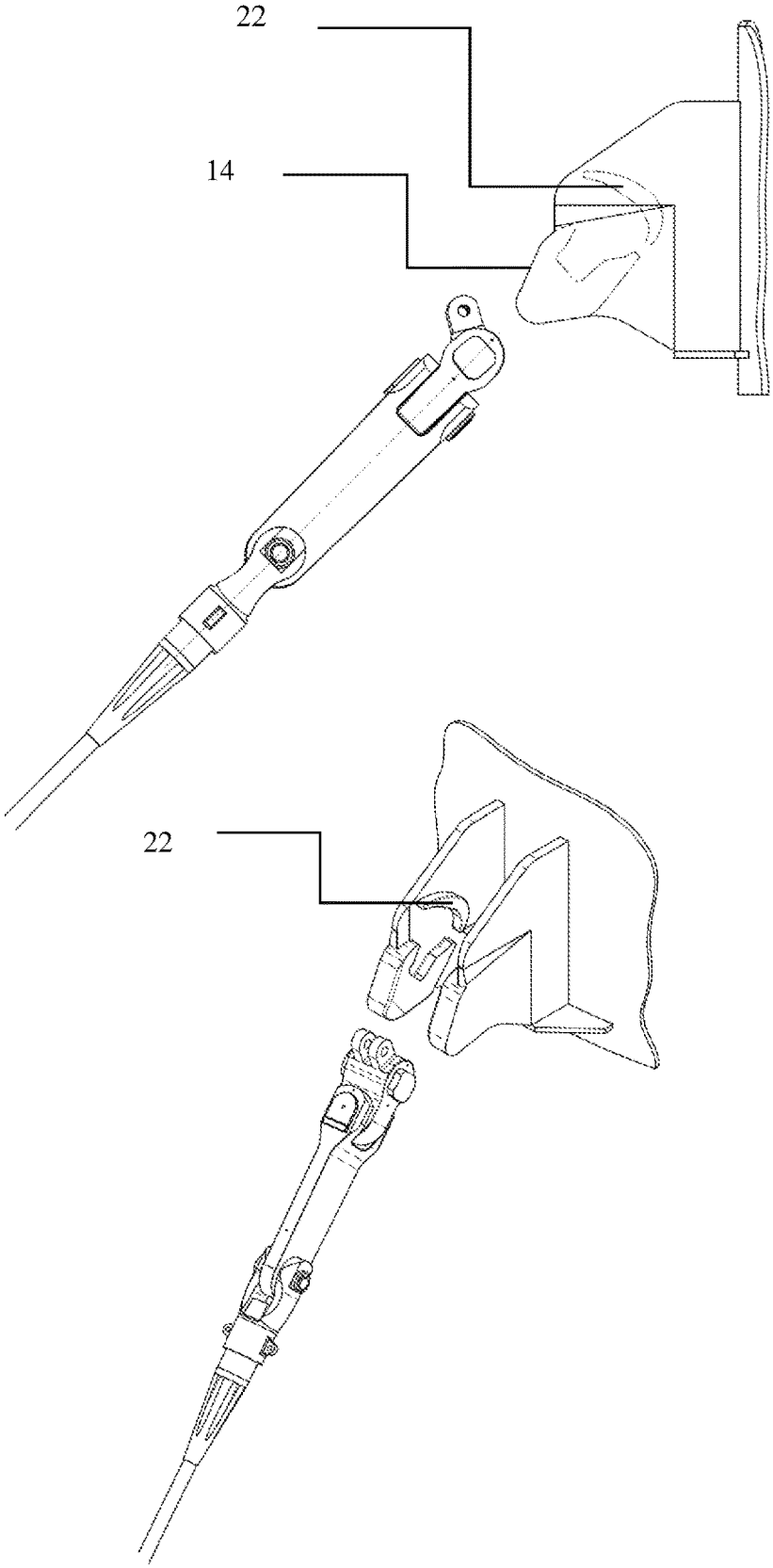
FIG. 12 shows hang-off hook pair and guide for top entry combined with longitudinal stopper

FIG. 12 shows an optional longitudinal stopper 22 on second part 2*b* for preventing first part 2*a* to be pulled too far past guides 14 and thus too far past hang-off hook pair 15 during connection and disconnection. Stopper 22 stops first part 2*a* when pin 10 hits the stopper. It will typically be a pair of stoppers, i.e. one for each end of pin 10.

Figure 13:
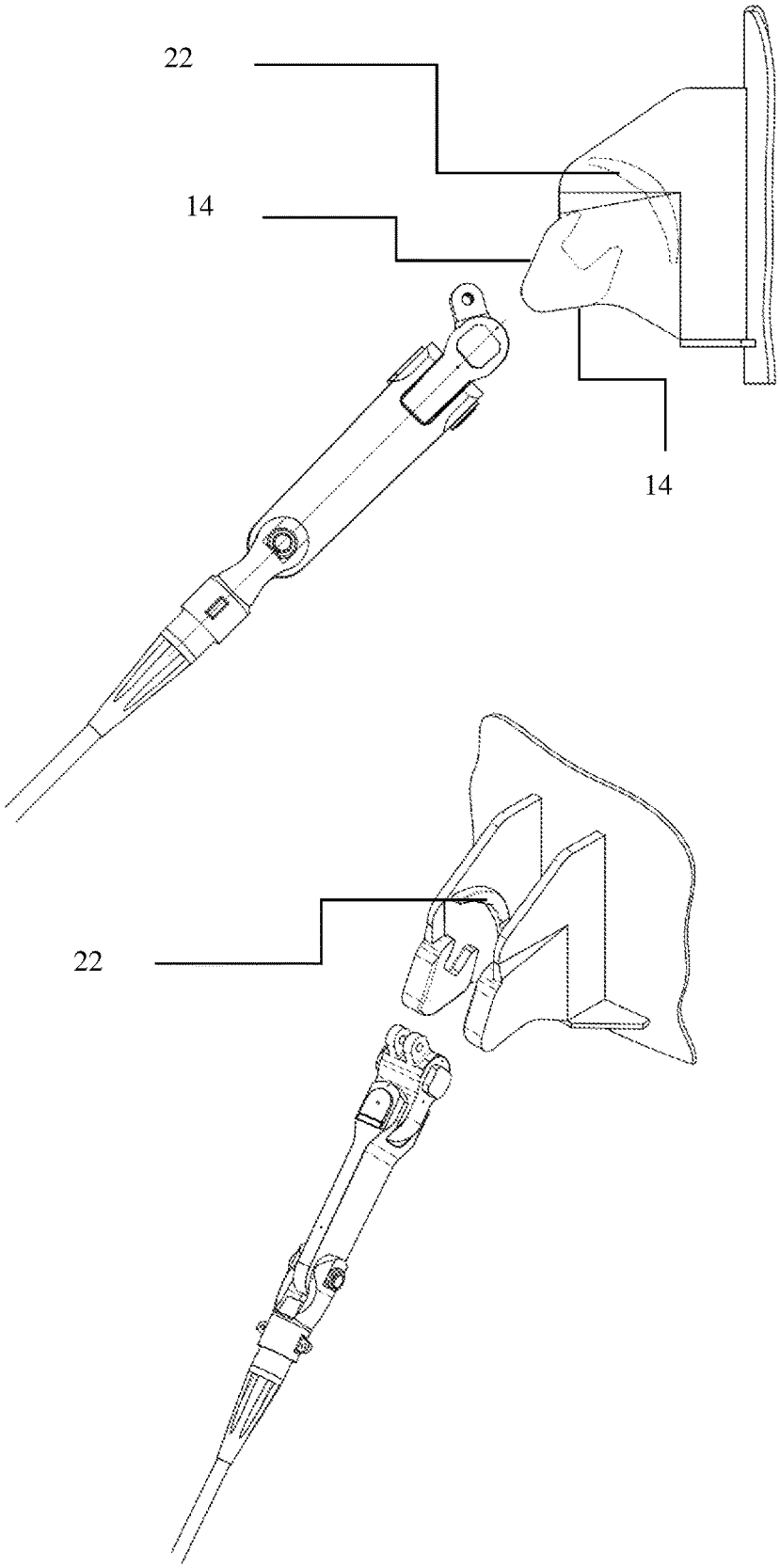
FIG. 13 shows hang-off hook pair and guide for top and bottom entry combined with longitudinal stopper

FIG. 13 shows an alternative design of guide structure 14 and stopper 22, which allows dual possibility for entry/exit of pin 10 into/from hang-off hook pair 15, i.e. either via top or bottom. FIG. 12 on the other hand shows a single entry/exit design where entry/exit is via top only.

Figure 14:
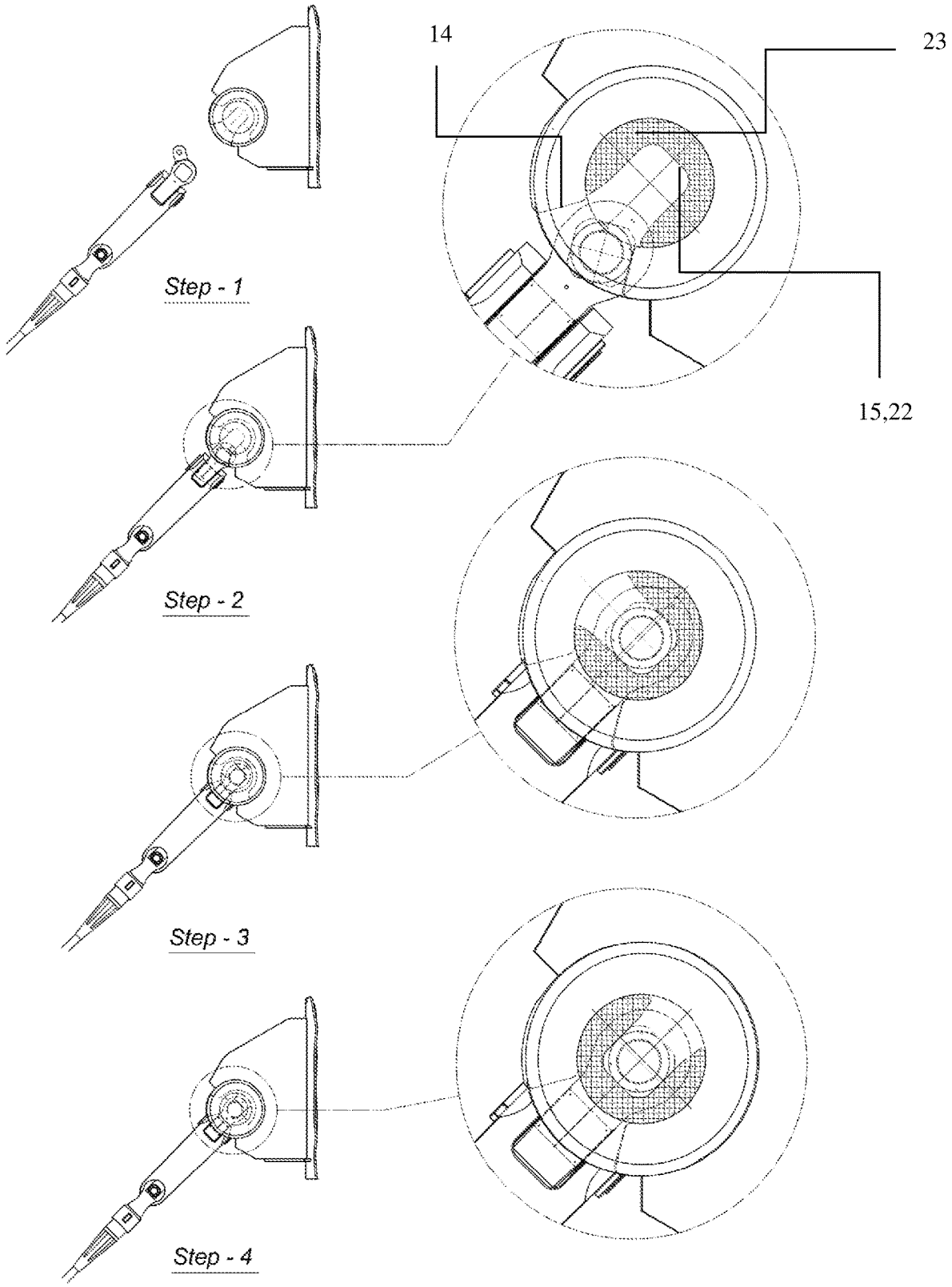
FIG. 14 shows side view of pull-in sequence for central entry into rotating hang-off hook pair
Figure 15:
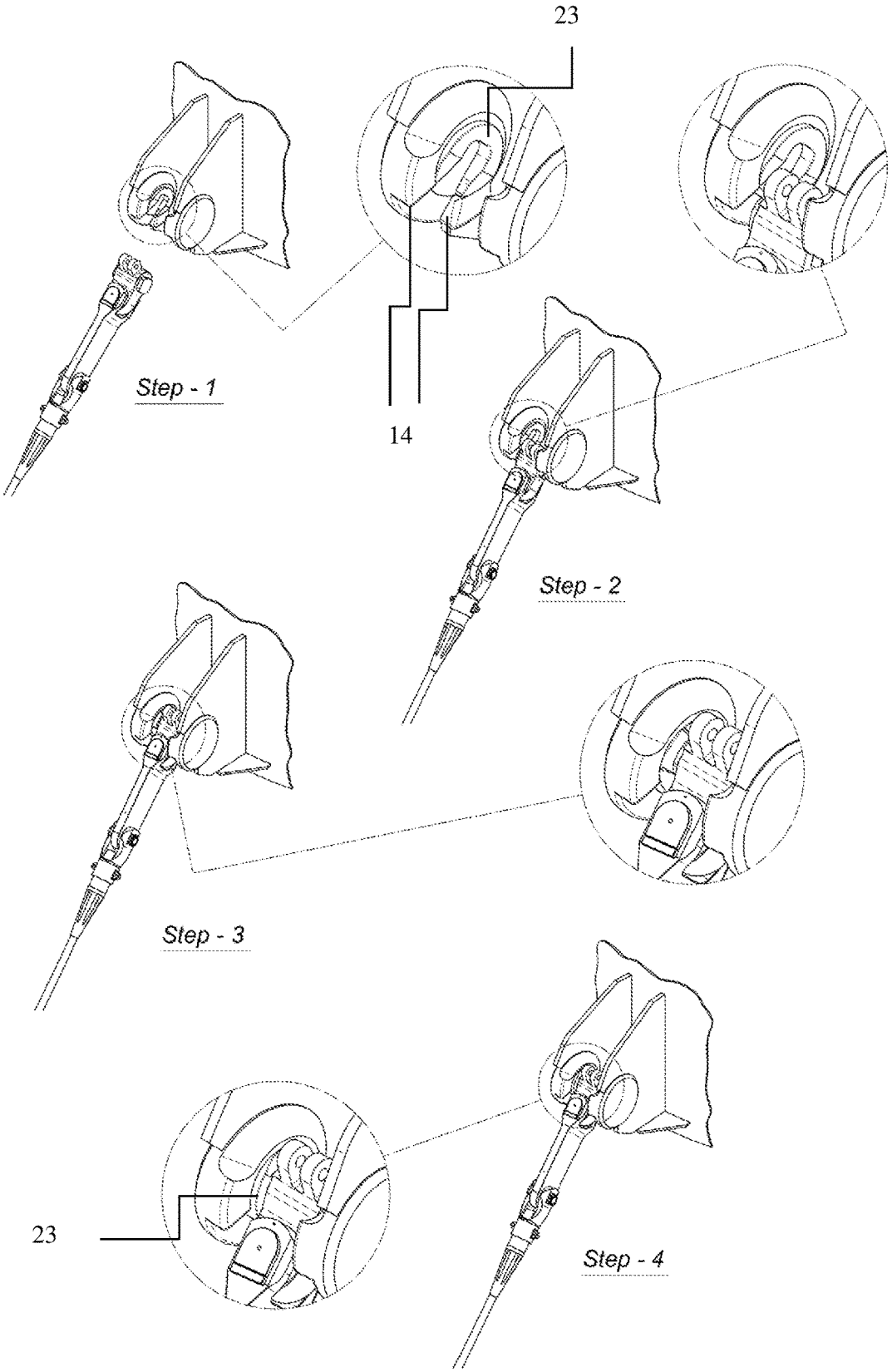
FIG. 15 shows pull-in sequence for central entry into rotating hang-off hook pair

FIG. 14 and FIG. 15 show an alternative design of the guide structure 14, hang-off 15 and stopper 22, where the guide structure 14 guides the pin 10 into a rotating joint 23, which is a combined stopper 22 and hang-off 15. When the pin 10 is touching the stopper 22, the joint 23 can be rotated such that the stopper 22 changes function from stopper to hang-off hook 15. The joint 23 will typically be rotated 90 to 180 degrees from a stopper function mode to a hang-off function mode. Step 1 in FIG. 14 and FIG. 15 show part 2*a* and part 2*b* in disconnected mode. Step 2 shows the guide structure 14 guiding pin 10 into the joint 23, which is in open mode. Step 3 shows pin 10 pulled to the end of joint 23 and with the joint rotated 90 degrees (closed or partly closed mode). Step 4 shows the same as Step 3, but with the joint rotated 180 degrees (closed mode). The situation in both Step 3 and Step 4 can lock part 2*a* to 2*b*. A secondary lock and/or an over-center-mechanism of joint 23 may be required to prevent it from opening unintentionally. Instead of a rotating locking mechanism as illustrated by joint 23 in FIG. 13 and FIG. 14, the pin 10 can be locked in many other ways, such as by spring-activated flaps that fall out and prevent pin 10 to move back after it has passed the flaps.

REFERENCE NUMERALS

1 Moored vessel/floating body
2 Mooring connection system
2*a* Part of connection system fixed to mooring line
2*b* Part of connection system fixed to moored unit or earth-fixed structure
3 Mooring line
4 Mooring anchor
5 Sea surface
6 Sea floor
7 Turret
8 Main connecting link
9 Secondary connecting link
10 Pin between main connecting link and moored unit or earth-fixed structure
11 Pin between main connecting link and optional secondary connecting link, or between main connecting link and mooring line if secondary connected link is omitted
12 Means to connect pull line to connection system
13 End of mooring line connected to system
14 Guide structure for pin 10
15 Hang-off hook pair for pin 10
16 Thimble with integrated/fixed pin
16*a* Thimble body
16*b* Integrated/fixed pin
17 Guide head on first part 2*a*
18 Pull line
19 Pin between optional secondary connecting link and mooring line
20 Lug structure
21 Longitudinal axis of first part 2*a*
22 Longitudinal stopper for pin 10
23 Manual, automatic or remotely operated hang-off hook pair
24 Bearing

The invention claimed is:

1. A connecting system for connecting a mooring line to a body, the system comprising:

a first part being attached to the mooring line and connected with a pin having two ends to a second part, the second part being attached to said body, and having a guide structure for guiding said pin into a hang-off structure in said second part, wherein the hang-off structure substantially comprises a hook pair; and a connecting structure for a temporary pulling means mounted in a transverse direction on an upper side of the first part and above a longitudinal axis of the first part to secure correct orientation of first part before touching the second part, wherein said second part comprises a stopper arrangement limiting a pull-in distance for said pin and thus said first part.

2. The connecting system according to claim 1, wherein said stopper arrangement is arranged to guide said pin into said hang-off structure.

3. A method for connecting a mooring line to a body using the connecting system according to claim 2, the method comprising the following steps:

a) attaching the first part of said connecting system to a mooring line;

b) attaching the second part of said connecting system to said body;

c) pulling a main connecting link including a pin, both being part of said first part, with a pulling line attached to the connecting structure on said first part through a guide structure on said second part into a hang-off structure on said second part; and d) hanging off said first part by said pin to said hang-off structure of said second part by relieving a pulling tension in said pulling line.

4. The connecting system according to claim 1, wherein a guiding arrangement in said second part for the pin, the pin being rotatably fixed to the first part, allows said pin to be guided along at least two sides of the hang-off structure.

5. A method for connecting a mooring line to a body using the connecting system according to claim 4, the method comprising the following steps:

a) attaching the first part of said connecting system to a mooring line;

b) attaching the second part of said connecting system to said body;

c) pulling a main connecting link including a pin, both being part of said first part, with a pulling line attached to the connecting structure on said first part through a guide structure on said second part into a hang-off structure on said second part; and d) hanging off said first part by said pin to said hang-off structure of said second part by relieving a pulling tension in said pulling line.

6. The connecting system according to claim 1, wherein a guide head partly enclosing said first part facilitates fine adjustment of directional and rotational position of the first part relative to the second part for guiding the first part in-between a lug structure of the second part.

7. The connecting system according to claim 6, wherein said connecting structure for temporary pulling means and said guide head for fine adjustment of directional and rotational position of said first part relative to said second part are a combined structure attached to said first part.

8. The connecting system according to claim 1, wherein said temporary pulling means is an auxiliary line temporarily connecting said first part to an external pulling device.

9. The connecting system according to claim 8, wherein said connecting structure for temporary pulling means and a guide head for fine adjustment of directional and rotational position of said first part relative to said second part are a combined structure attached to said first part.

10. The connecting system according to claim 1, wherein said connecting structure for temporary pulling means and a guide head for fine adjustment of directional and rotational position of said first part relative to said second part are a combined structure attached to said first part.

11. The connecting system according to claim 1, wherein the guiding structure in said second part is arranged to guide said pin into a final position and where the pin in its final position is locked by means operated by one of the group consisting of gravity, spring force, manual operation and use of a remotely operated vehicle.

12. The connecting system according to claim 1, wherein at least one secondary connection link is inserted between a main connecting link and the mooring line to reduce in-plane and out-of-plane loads in the mooring line due to friction in means for rotational movements between the first and the second part of the system and between the second part of the system and the mooring line.

13. The connecting system according to claim 1, wherein said hang-off structure is a pair of hooks, each hook being arranged to engage one end of said pin.

14. A method for connecting a mooring line to a body using the connecting system according to claim 1, the method comprising the following steps:

a) attaching the first part of said connecting system to a mooring line;

b) attaching the second part of said connecting system to said body;

c) pulling a main connecting link including a pin, both being part of said first part, with a pulling line attached to the connecting structure on said first part through a guide structure on said second part into a hang-off structure on said second part; and d) hanging off said first part by said pin to said hang-off structure of said second part by relieving a pulling tension in said pulling line.

15. The method according to claim 14, wherein said pulling line is attached to said system before step c) and removed after performing step d).

16. The method according to claim 14, wherein at least one secondary connection link is inserted between said mooring line and said main connecting link during step a).

17. The method according to claim 14, wherein said pulling is performed by one of a group consisting of a supplementary vessel and a pulling device on board said body.

18. The method according to claim 17, wherein said pulling line runs through a sheave arrangement, said sheave being attached to:

said body if said mooring line is to be connected to said body; and a mooring anchor if said mooring line is to be connected to said anchor.

* * * * *